US008618395B2

(12) United States Patent
LeRoux

(10) Patent No.: US 8,618,395 B2
(45) Date of Patent: Dec. 31, 2013

(54) CHROMATIC TAMBIN AND RELATED METHODS

(76) Inventor: Sylvain LeRoux, New York, NY (US)

( * ) Notice: Subject to any disclaimer, the term of this patent is extended or adjusted under 35 U.S.C. 154(b) by 0 days.

(21) Appl. No.: 13/326,930

(22) Filed: Dec. 15, 2011

(65) Prior Publication Data

US 2013/0152764 A1 Jun. 20, 2013

(51) Int. Cl.
*G10D 7/02* (2006.01)

(52) U.S. Cl.
USPC ..... 84/384; 84/330

(58) Field of Classification Search
USPC ..... 84/384, 330
See application file for complete search history.

(56) References Cited

U.S. PATENT DOCUMENTS

| | | | | | |
|---|---|---|---|---|---|
| 43,438 | A | * | 7/1864 | Tanner | 84/386 |
| 45,270 | A | * | 11/1864 | Pfaff | 84/384 |
| 274,617 | A | * | 3/1883 | Lang | 84/384 |
| 444,830 | A | * | 1/1891 | Guenther | 84/384 |
| 801,086 | A | * | 10/1905 | Jenks | 84/384 |
| 1,618,892 | A | * | 2/1927 | Skinner | 84/384 |
| D153,275 | S | * | 4/1949 | Frazeur | D21/411 |
| 2,823,571 | A | * | 2/1958 | Herod | 84/384 |
| 3,326,073 | A | * | 6/1967 | Tremaine | 84/380 C |
| 3,363,498 | A | * | 1/1968 | Uebel et al. | 84/384 |
| 3,398,624 | A | * | 8/1968 | Stoessel et al. | 84/330 |
| 3,438,298 | A | * | 4/1969 | Thompson | 84/380 C |
| 3,558,797 | A | * | 1/1971 | Wolford | 84/384 |
| 3,570,358 | A | * | 3/1971 | Guinness | 84/380 C |
| 3,585,896 | A | * | 6/1971 | Muller | 84/384 |
| 3,685,388 | A | * | 8/1972 | Young | 84/384 |
| 4,129,058 | A | * | 12/1978 | Ross | 84/485 R |
| 4,306,484 | A | * | 12/1981 | Toyama | 84/380 R |
| 4,539,888 | A | * | 9/1985 | Whelan | 84/380 B |
| 6,696,629 | B1 | * | 2/2004 | Cooper, Jr. | 84/385 R |
| 7,375,270 | B2 | * | 5/2008 | Abernethy | 84/380 R |
| 7,700,863 | B2 | * | 4/2010 | Bear | 84/380 R |
| 8,304,641 | B1 | * | 11/2012 | Stewart | 84/483.2 |
| 8,314,318 | B2 | * | 11/2012 | Brockman | 84/386 |

OTHER PUBLICATIONS

Seeler, Oliver, Tuning The Bagpipe, Basic Principles & Random Advice, Dec. 2004, viewed on Feb. 6, 2013 at http://www.hotpipes.com/tuning.html.*

Cushings, Joshua, Fifer's Companion No. 1, Fife Fingering Chard, cir 1804, viewed on Feb. 6, 2013 at http://www.fifedrum.org/crfd/images/Scale.htm.*

Tambin: The Fula Flute, published in the Saharan Vibe, Dec. 3, 2008, viewed on Jan. 30, 2013 at http://saharanvibe.blogspot.com/2008/12/tambin-fula-flute.html.*

Tin Whistle vs. Recorder, use of tape to cover a tone hole, 5 years ago viewed on Feb. 6, 2013 at http://thesession.org/discussions/13650.*

The New York Flute Club Newsletter, (Nov. 2003) viewed on Sep. 20, 2013 at http://www.fulaflute.net/fula_flute/music/reviews/03_nyfc_nwltr_art.pdf.*

* cited by examiner

*Primary Examiner* — Robert W Horn
(74) *Attorney, Agent, or Firm* — Buche & Associates, P.C.; John K. Buche

(57) ABSTRACT

The disclosed tambin generally features: a hollow tubiform body that is generally conical; a plug for blocking the wide end of the body; an embouchure that is adjacent to the wide end of the body; and six finger holes that are spaced along the body toward its pointed end.

17 Claims, 9 Drawing Sheets

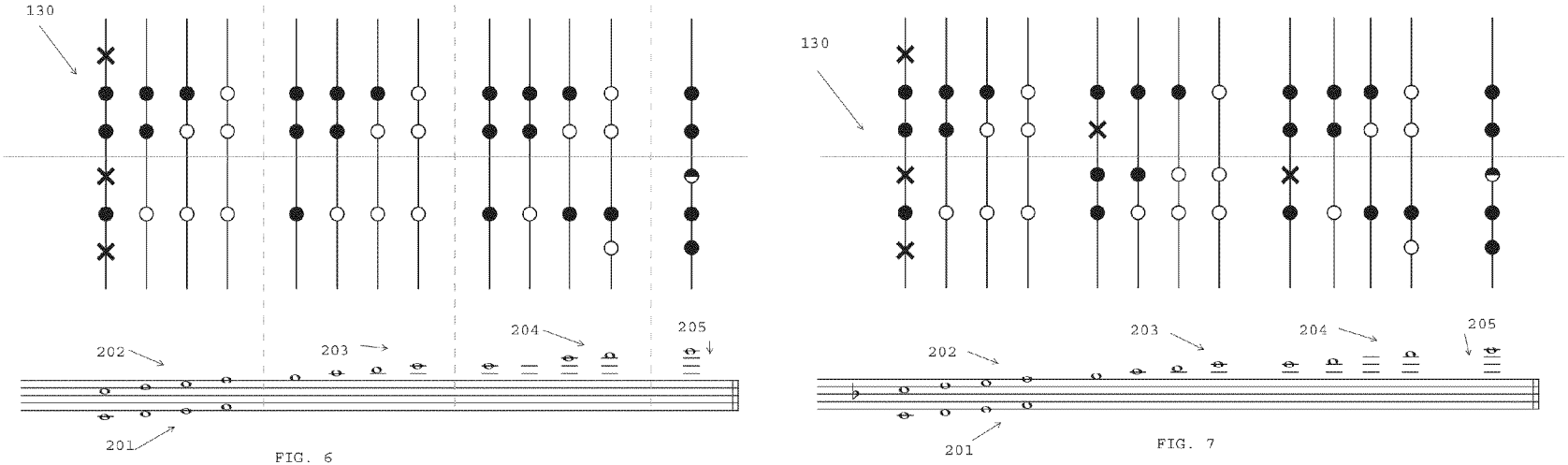
FIG. 6
FIG. 7
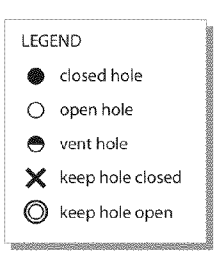
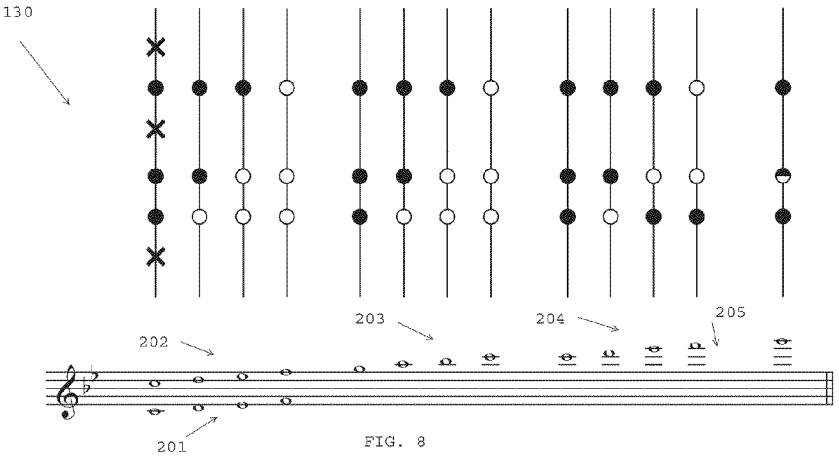
FIG. 8

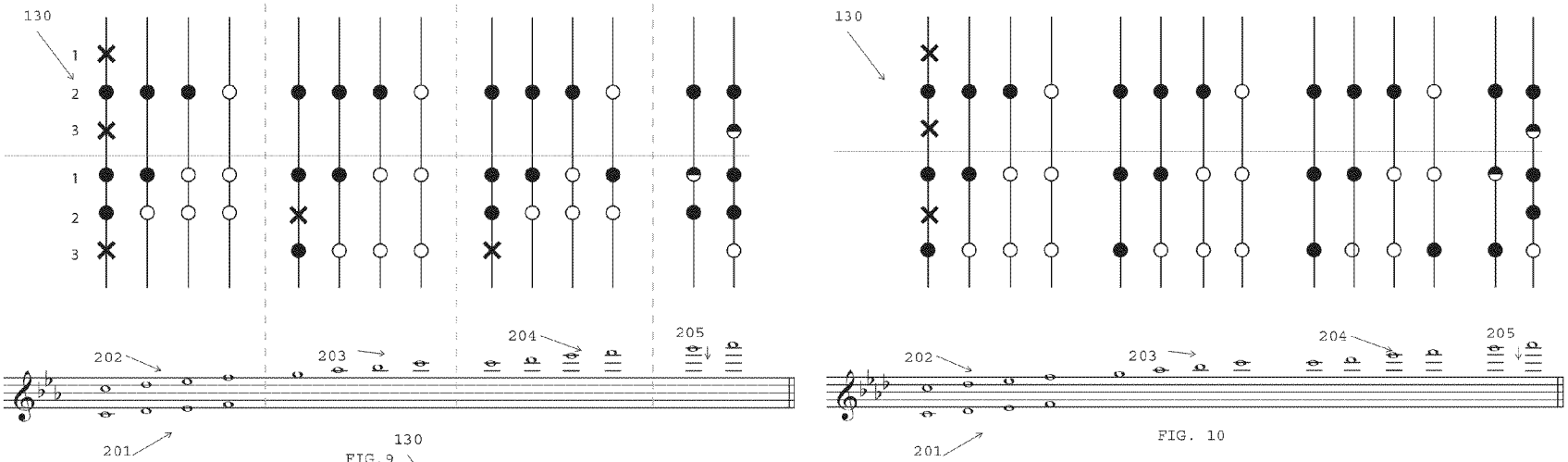
FIG. 9
FIG. 10
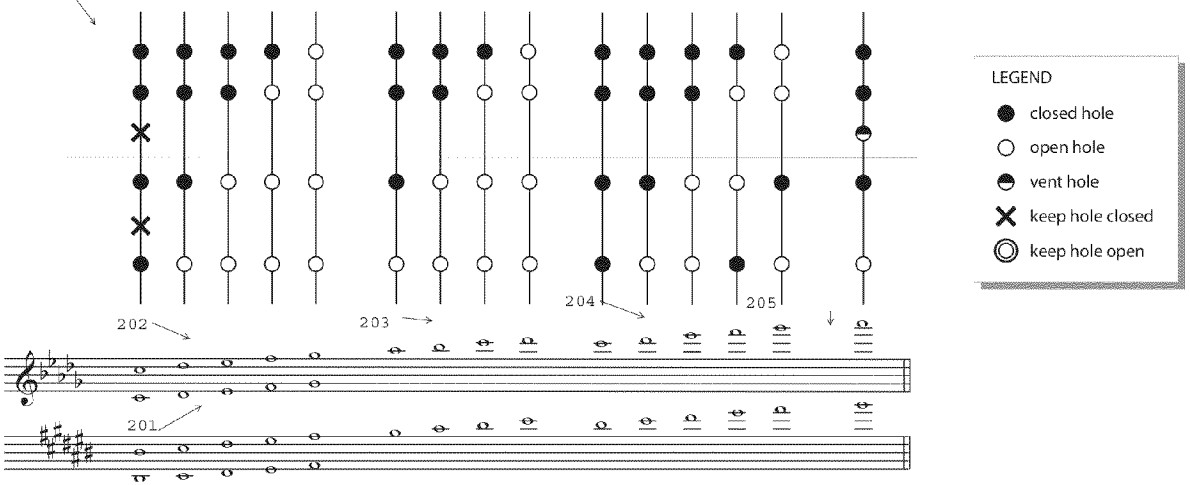
FIG. 11

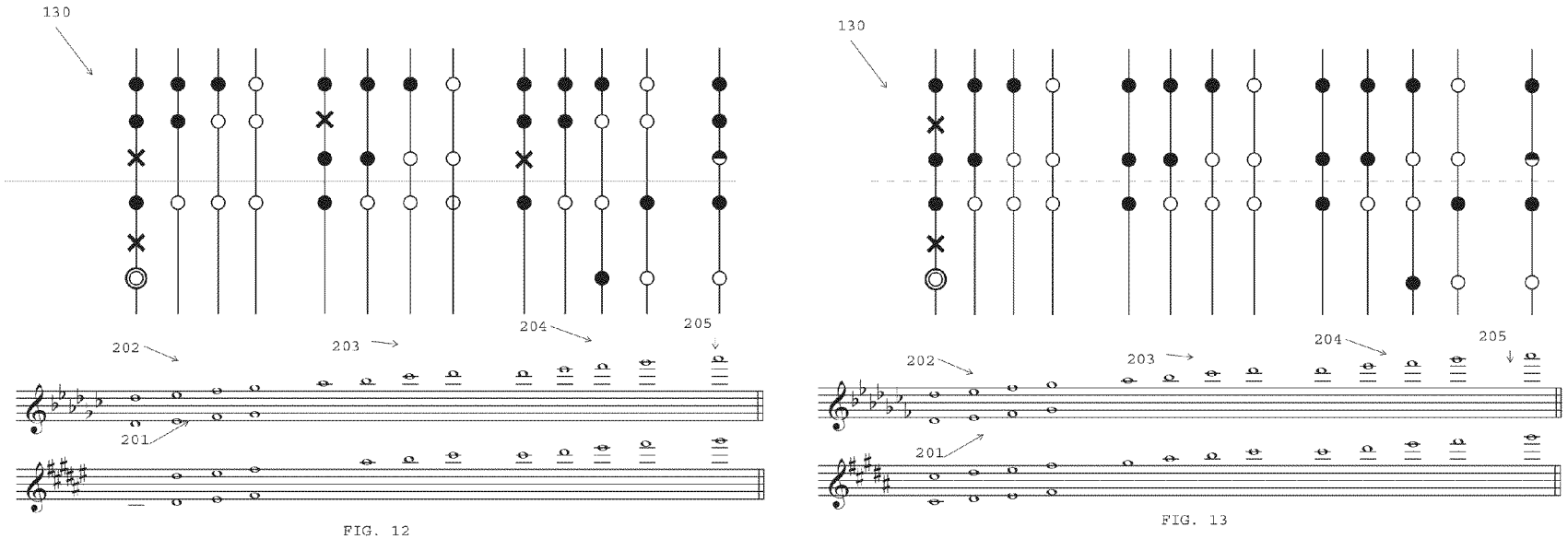
FIG. 12
FIG. 13
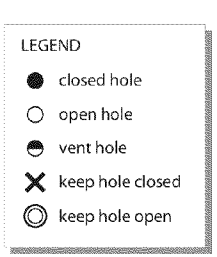
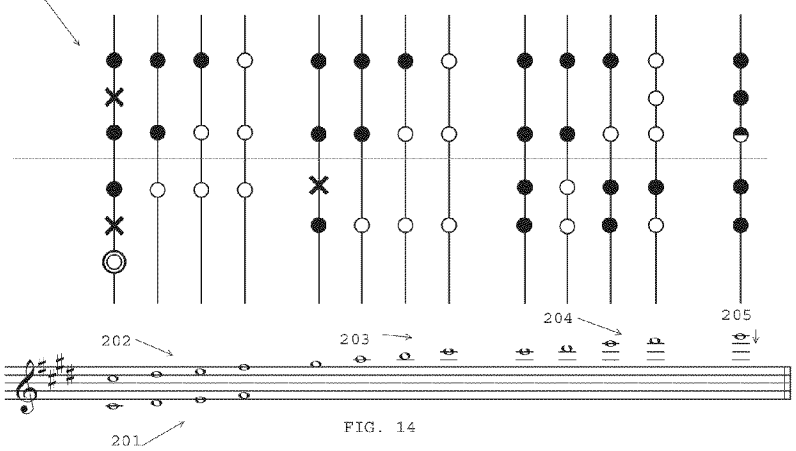
FIG. 14

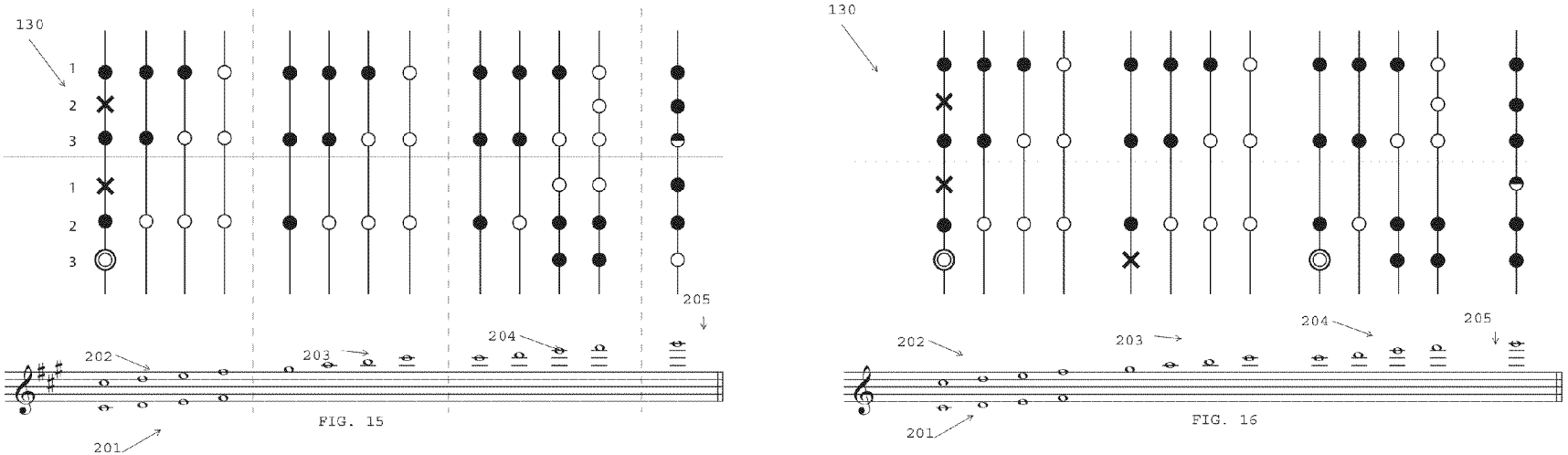
FIG. 15
FIG. 16
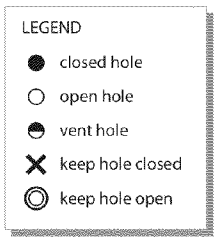
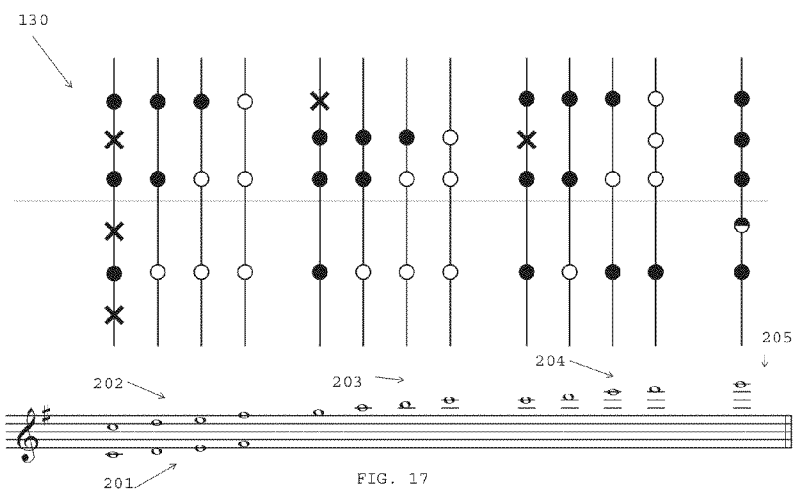
FIG. 17

CHROMATIC TAMBIN AND RELATED METHODS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of Invention

This application is in the field of musical instruments, including woodwind instruments.

2. Background.

The classic tambin (depicted in FIG. 1) is a woodwind instrument from Guinea, West-Africa. Structurally, the classic tambin has a conical (or cylindrical) and tubiform body with a plugged wide end (typically of one inch diameter), known colloquially as the "head," and an open pointed end (typically of five eighths inch diameter), known colloquially as the "foot". The classic tambin typically features: a large, winged, and rectangular embouchure with a bee's wax chamber adjacent to the head and three finger holes toward the foot. Operably, the classic tambin produces one complete diatonic scale with seven notes over one and a half octaves, wherein the notes are typically within the second to fourth registers.

The classic tambin produces powerfully haunting and "organic" sounds which may be incorporated into musical compositions. Regardless of the quality or character of classic tambin sounds, music composers may not be able to introduce tambin sounds into their musical compositions since the tambin is limited by its diatonic scale and register range. Said limitations are particularly evident to composers of Jazz, Blues, and other contemporary or non-african music styles. The tambin is, thus, not entirely a satisfactory woodwind instrument for some musical composers since such composers must either prepare tambin specific musical compositions or forgo introducing tambin sounds into their music whenever the composition is beyond the tambin's register or scale.

Other unsatisfactory aspects of the classic tambin also exist with regard to tambin tuning. Typically a tambin's tune is defined by either (a) the specific location of the finger holes along its body or (b) the length of the body. As a result, tambin tuning may be problematic for a musician since the musician must either carry multiple tambins of different tuning (i.e., tambins with different hole placement or lengths) or carry a single tambin whereby the musician is restricted to a single tambin tune.

SUMMARY OF THE INVENTION

In view of the foregoing, it is an object of this application to disclose a woodwind instrument that produces tambin sounds over a chromatic scale and beyond the fourth register. It is also an object of this application to disclose a woodwind instrument that may be tuned. It is a further object of this application to disclose a woodwind instrument that may be used to produce all the chromatic notes with only six finger holes. It is yet still an object of the invention to disclose a tambin which produces a chromatic scale without resorting to half-holes and forked fingerings, unlike other woodwind instruments with six or seven finger holes. In one preferable embodiment, the wood wind instrument disclosed herein features: a hollow tubiform body that is generally lengthwise conical; a plug for blocking the wide end of the body; an embouchure that is adjacent to the wide end of the body; between four and six finger holes that are spaced along the body toward its pointed end. Operably, the disclosed instrument may be tuned by selectively blocking one or more of the holes (e.g., by covering the hole with tape or other decorative ornamentation).

BRIEF DESCRIPTION OF THE FIGURES

The manner in which these objectives and other desirable characteristics can be obtained is better explained in the following description and attached figures in which.

It is to be noted, however, that the appended figures illustrate only a typical embodiment of the invention. As a result, the figures are not to be considered limiting of the scope of the underlying invention. That is to say, the disclosed invention may admit to other equally effective embodiments that will be appreciated by those reasonably skilled in the relevant arts and the drawings are not necessarily drawn to scale.

DETAILED DESCRIPTION OF PREFERRED EMBODIMENTS

This specification discloses a tambin that produces sounds over a chromatic scale and beyond the fourth register. The disclosed tambin generally features: a hollow tubiform body that is generally conical; a plug for blocking the wide end of the body; an embouchure that is adjacent to the wide end of the body; and between three and six finger holes that are spaced along the body toward its pointed end. Operably, the disclosed instrument may be tuned by selectively blocking one or more of the holes (e.g., by covering the hole with tape or other decorative ornamentation). The more specific structural and operable details of the tambin are disclosed with reference to the figures.

Figure 1:
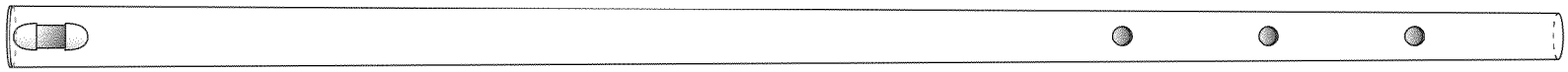
FIG. 1 is a plan view of a traditional or classic tambin.
Figure 2:
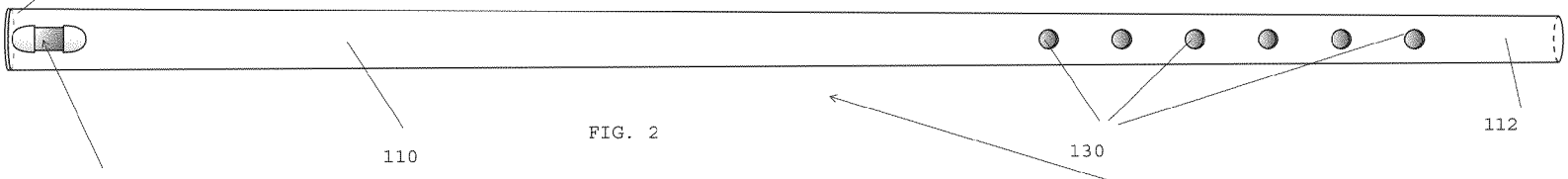
FIG. 2 is a plan view of a chromatic tambin 100.

FIG. 2 is a plan view of a chromatic tambin 100. As seen in the figure, the tambin 100 is defined by (1) a body 110 with a head 111 and a foot 112, (2) a embouchure 120 (defined by a blow-hole 121 and wings 122) adjacent to the head 111, and (3) finger holes spaced along the foot 112 of the body 110.

Referring still to FIG. 2, the body 110 is a conical tubiform with the head 111 defining the widest end and the foot defining the narrowest end 110. Suitably: a "C" scale tambin 100 may feature a body 110 that is twenty-six and six hundred and seventy-five thousandths inches in length, is one inch in diameter at the head 111, and is three-quarters of an inch in diameter at its foot; a "B" scale tambin 100 may feature a body 110 that is twenty-five and one hundred and twenty-five thousandths inches in length, is one inch in diameter at the head 111, and is three-quarters of an inch in diameter at its foot; a "A#" scale tambin 100 may feature a body 110 that is twenty-seven and eight hundred and seventy-five thousandths inches in length, is one inch in diameter at the head 111, and is three-quarters of an inch in diameter at its foot; and, a "A" scale tambin 100 may feature a body 110 that is twenty-nine and six hundred and seventy-five thousandths inches in length, is one inch in diameter at the head 111, and is three-quarters of an inch in diameter at its foot. Suitably, the body 110 may be formed of wood, metal, plastic, or glass. Preferably the head 111 of the body is plugged with a plug 113. In the "C" scale tambin 100, the plug 113 is preferably only configured to extend from the head to within the body's 110 tubiform for a distance of one hundred and twenty-five thousandths inches in length. As discussed further below, the body 110 is provided with an embouchure 120 and finger holes 130.

Figure 3B:
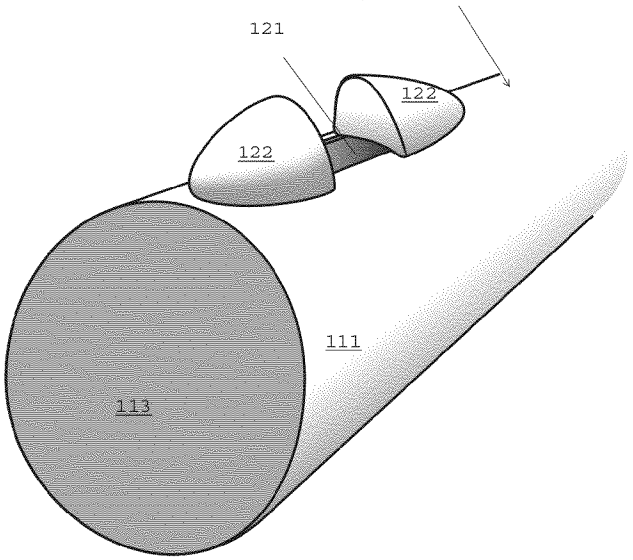
FIG. 3B is a perspective view of the head 200 of the tambin 100 of FIG. 2.
Figure 3A:
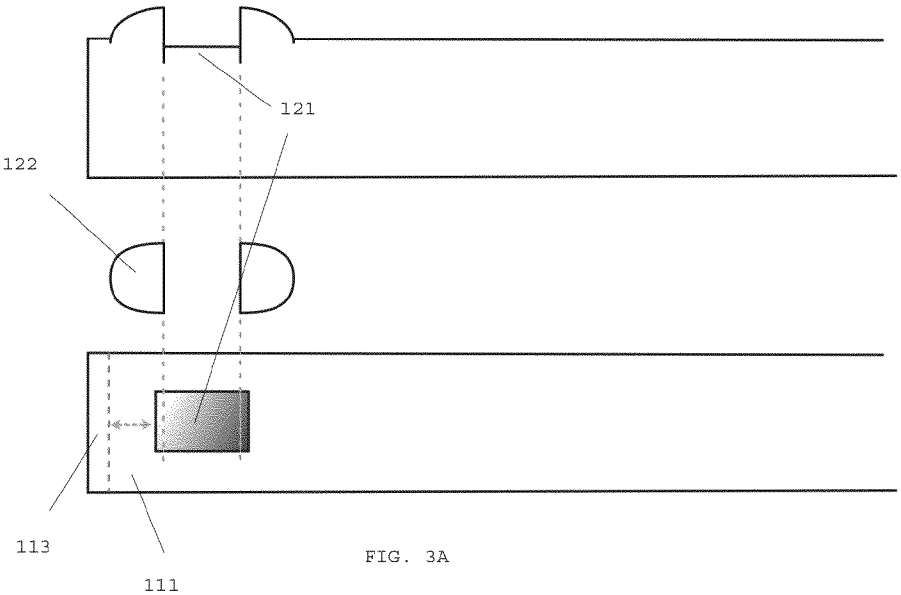
FIG. 3A is a cross-section and exploded view of the head 200 of the tambin 100 of FIG. 2.

FIGS. 3A and 3B are respectively a diagram and perspective view of the embouchure 120 adjacent to the head 111 of the body 110. As seen in the figure, the embouchure 120 is defined by a blow-hole 121 and wings 122. The blow-hole 121 may preferably be a rectangular cut-out through the wall of the body 110. The wings 122 may be preferably positioned on either side of the blow-hole 121. Operably, a musician may put his or her mouth over the blow-hole 121 so that the wings 122 interact with the musician's lips to create a chamber at the mouth of the player, which chamber enables the clear production of notes (without the wings sound would be unfocused and unstable). In the "C" scale tambin 100: the blow-hole 121 is rectangular (three-hundred and seventy-five thousandths of an inch by one half of an inch) positioned lengthwise on adjacent to the head 111 of the body 110 one-half of an inch from the edge of the body 110; and, the wings 122 are made of bees wax (or similar material like molded plastic, metal, glass, integrated with the body of the flute, and etcetera), semi elliptical, one quarter inch high (relative to the outer surface of the body 100), and six-hundred and twenty-five thousandths of an inch in length, and just wider than the blow-hole 121.

Referring once again to FIG. 2, the tambin 100 preferably features finger holes 130 along the foot 112 side of the body 110. Suitably, the finger holes 130 may be defined by round cut-outs through the wall of the body 110. In a preferable embodiment, six finger holes 130 are provided to the tambin 100. In a "C" scale tambin 100. The finger holes 100 may be five sixteenths of an inch in diameter and spaced approximately one inch apart with the center of the first hole being positioned two inches from the foot 130-side edge of the body 110. Operably, the finger holes 130 are configured to be covered (in whole or in part (i.e., partially covered or vented)) by the finger tips of a musician. Alternatively, a finger hole may be continuously covered by tape or another type of plug.

Figure 4:
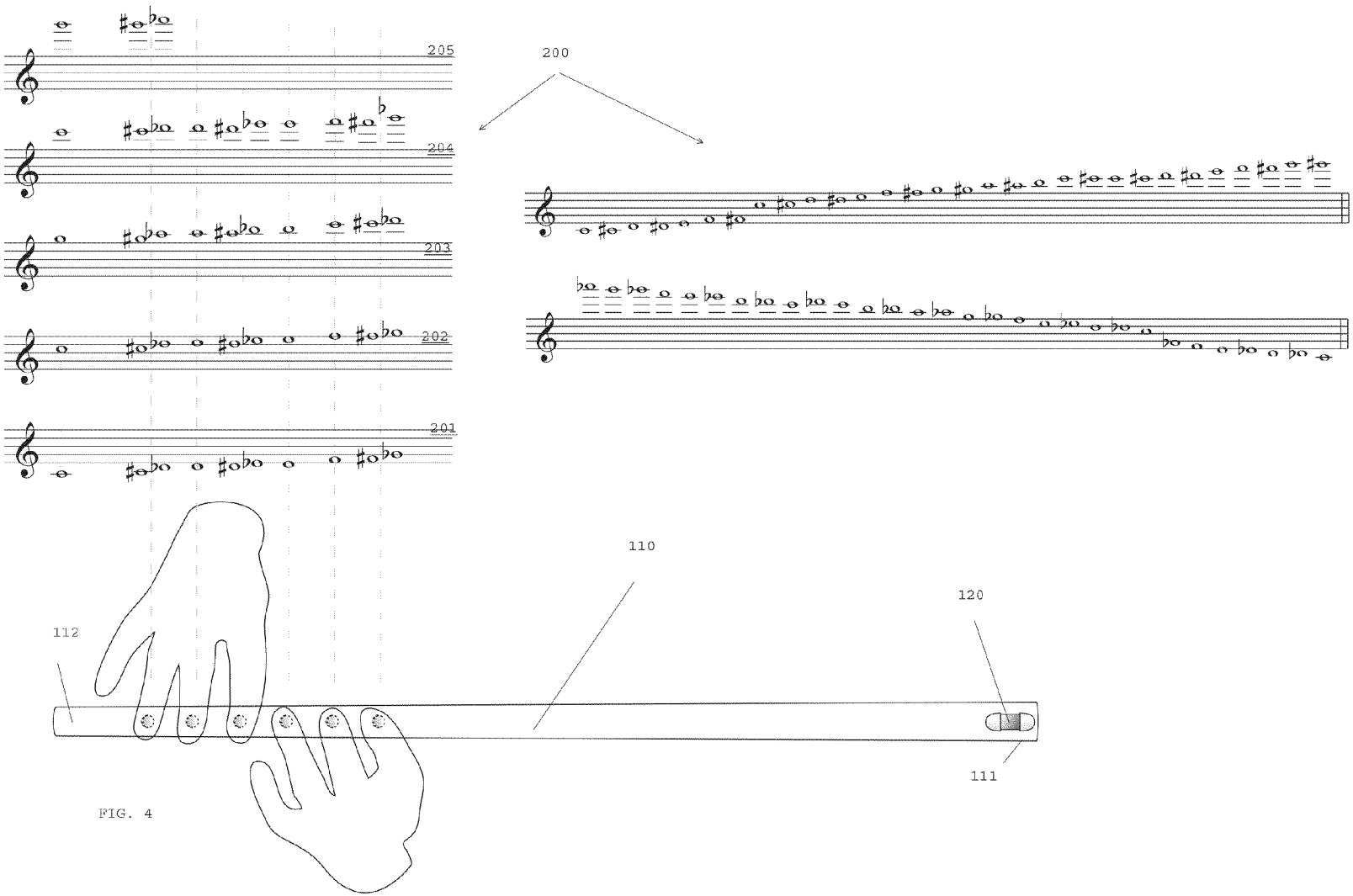
FIG. 4 is an illustration of a right-handed position for holding a tambin; and, FIGS. 5 through 17 respectively illustrate finger placements for the notes in the chromatic scale (FIG. 5), the C major scale (FIG. 6), the F major scale (FIG. 7), the B flat major scale (FIG. 9), the E flat major scale (FIG. 10), the A flat major scale (FIG. 11), the D flat major scale (FIG. 12), the G flat/F sharp major scale (FIG. 12), the C flat/B major scale (FIG. 13), the F major scale (FIG. 14), the A major scale (FIG. 15), the D major scale (FIG. 16), and the G major scale (FIG. 17)

Operably, a musician may play the tambin 100 via blowing into the embouchure 120 while selectively covering the finger holes 130 to change the note and/or pitch of the sound emitted from the tambin 100. FIG. 4 is a diagram for right-handed placement on a tambin 120. As shown in the drawings, a preferable finger placement is: with the right index finger on the third finger-hole 130 from the foot 112, the right middle finger on the second finger hole 130 from the foot 112, and the right ring finger on the closest finger hole to the foot; and, with the left index finger on the sixth finger hole from the foot, the left middle finger on the fifth finger hole 130 from the foot 112, and the left ring finger on the fourth finger hole 130 from the foot 112. Although not shown in the drawing, a musician's thumb may be positioned underneath the tambin 100 to support the instrument while it is being played.

The range 200 of a "C" scale tambin 100 is also depicted in FIG. 4. Above the finger holes in the drawings, the range 200 is broken down into registers with the first register 201 being shown underneath the second register 202, the second register 202 being shown underneath the third register 203, the third register being shown underneath the fourth register, and the fourth register 204 being shown beneath the fifth register 205. The notes capable of being achieved within each register using the tambin 100 are illustrated in the usual manner known in the industry (it should be noted: however that the last two notes of the third register have the same pitch as the first two notes of the fourth register because c sharp and d flat are the same note).

Figure 5:
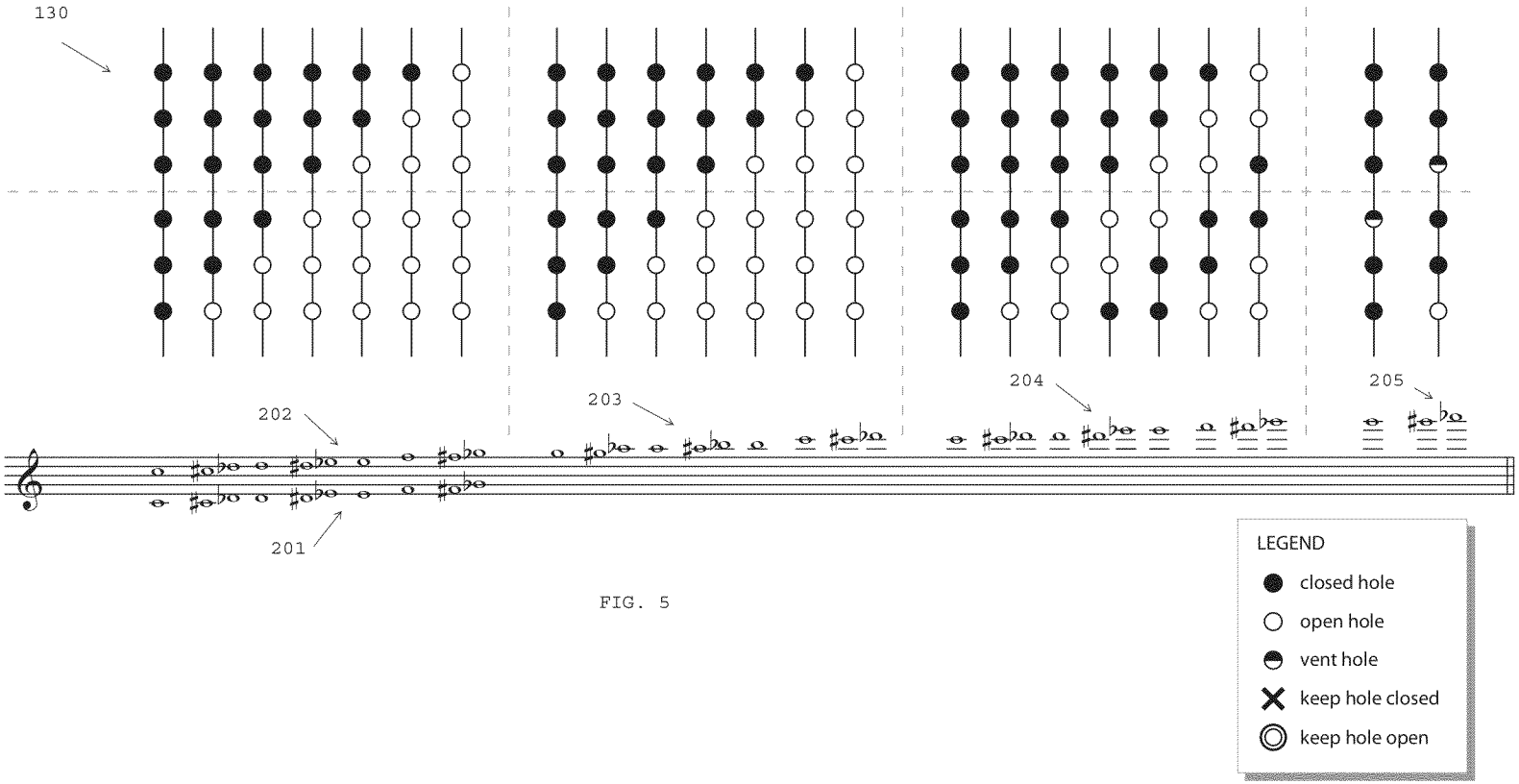
Figure 18:
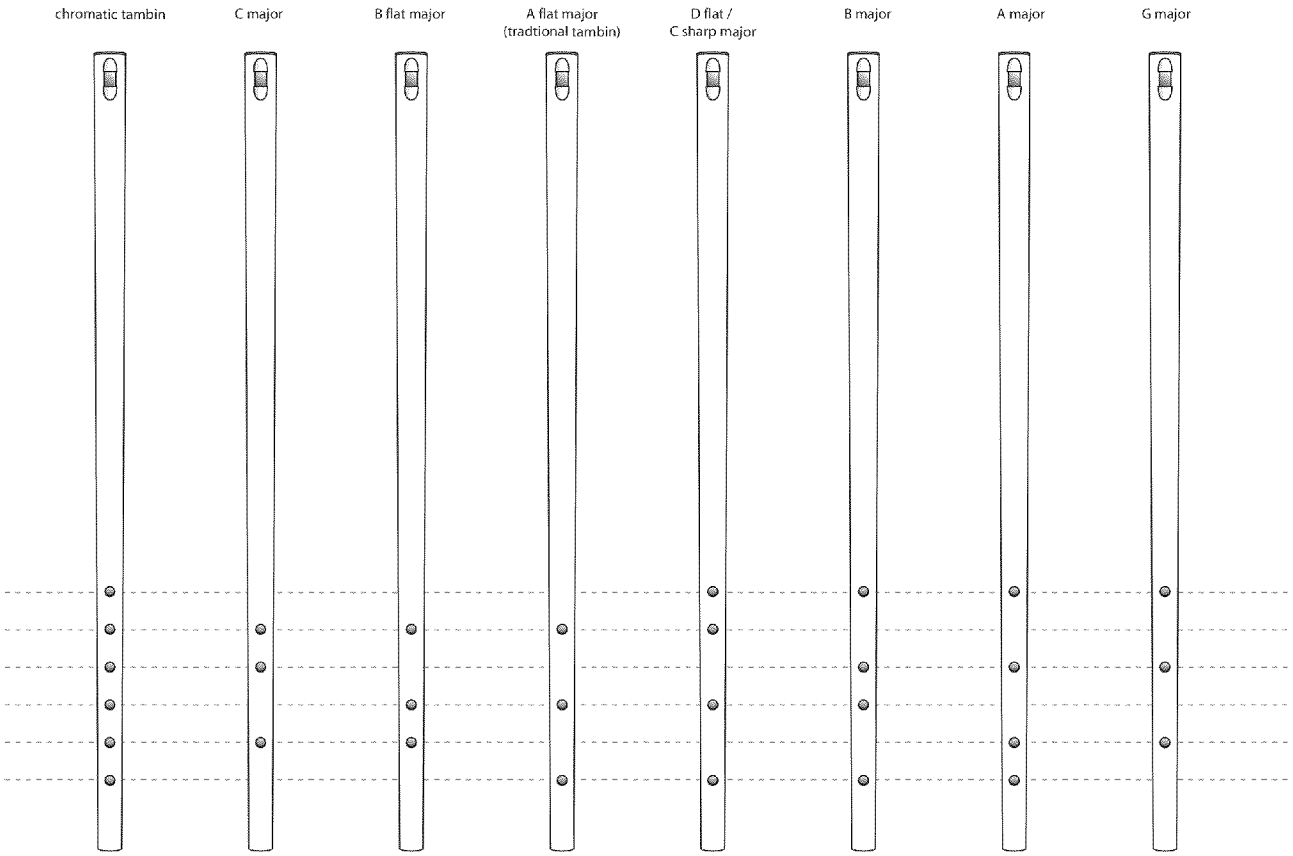
FIG. 18 is a diagram of variously tuned tambins.

FIGS. 5 through 17 are diagrams of finger placements for all the notes of a variously scaled tambins 100. In the figures, the six finger holes 130 are represented above the note with the finger hole closest to the foot positioned closest to the scale and wherein the particular configuration of the finger holes results in the corresponding note. The applicable configuration of the finger holes 130 of a tambin 100 are represented by: (1) a black circle for a closed finger hole 130; (2) a white circle for an open hole; (3) a half black circle for a vented (e.g., partially closed) finger hole 130; an "X" for a continuously closed finger hole 130; and a double circle for a continuously open finger hole 130. FIGS. 5 through 17 respectively illustrate finger placements for the notes in the chromatic scale (FIG. 5) (note: some pitches in the fourth 204 and fifth 205 registers may require the use of forked fingerings and vented holes), the C major scale (FIG. 6) (note: when the holes are marked with an X the hole is preferably plugged and the finger corresponding to the blocked finger hole may be placed on the plug or the tambin), the F major scale (FIG. 7), the B flat major scale (FIG. 9), the E flat major scale (FIG. 10), the A flat major scale (FIG. 11), the D flat major scale (FIG. 12), the G flat/F sharp major scale (FIG. 12), the C flat/B major scale (FIG. 13), the F major scale (FIG. 14), the A major scale (FIG. 15), the D major scale (FIG. 16), and the G major scale (FIG. 17). In the figures, the basic finger positions are represented by the first finger-hole column on the far left and the notes of each scale are grouped according to the applicable register (201 through 205). FIG. 18 is a diagram of tambins configured to the various scales (from left to right the chromatic, the C major, the B flat, the A flat major (traditional), D flat or C sharp major, B major, A major, and G major).

Figure 19A:
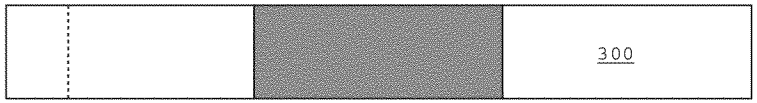
FIG. 19A through 19C are respectively top, bottom, and environmental views of a plug for a finger hole of a tambin.
Figure 19B:
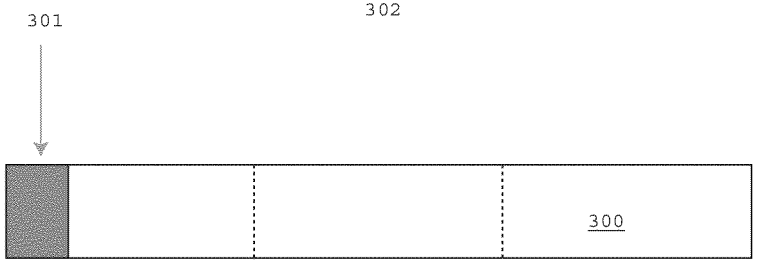
Figure 19C:
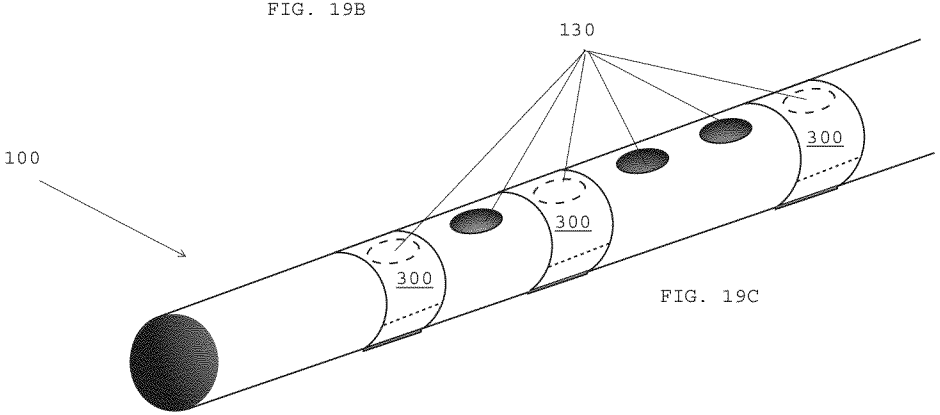

As a discussed above, a musician using the disclosed tambin 100 may be desirous of continuously covering a finger hole 130 by tape (e.g., electrical tape) or another type of plug rather than continuously positioning his or her finger over the hole. In one embodiment a plug for continuously covering a finger hole 130 may be defined by a strap 300 with hooks 301 and loops 302 (e.g., Velcro®) as a means for securing the strap over a finger hole. FIGS. 19A through 19C are respectively front, back, and environmental views of such a strap. As shown in FIGS. 19A and 19B, the strap 300 is preferably a rubber ribbon with a plurality of loops 302 adhered to its midsection on one side and a plurality of hooks 301 adhered to one of its tips on the other side. Operably, the strap 300 may be: first, wrapped around a tambin 100 with the hoops 300 facing outward and so that the strap 100 is positioned over one of the finger holes 130; second, the strap 300 may be pulled taut so that the finger hole 130 and strap 100 interface is air-tight; and third, the hooks may be coupled with the loops to hold the strap 300 taut. The result of said operation is depicted in FIG. 19C wherein three of the depicted tambin's 100 finger holes 130 are covered by the straps 300.

This specification and the appended figures illustrate only typical embodiments or principles disclosed in this application, and therefore, are not to be considered limiting of its scope, for the invention may admit to other equally effective embodiments that will be appreciated by those reasonably skilled in the relevant arts. Any invention disclosed by this specification is defined by the claims.

I claim:

1. A tambin comprising:
a body that is configured with
a conical tubiform,
a head defining the widest end,
a foot defining the narrowest end; and
wherein the body is from any of the group of materials consisting essentially of:
wood, metal, plastic, or glass;
a plug for the wider side of the conical tubiform of the body;
a chambered embouchure adjacent to the plug wherein said embouchure is defined by:
a blow-hole rectangular cut-out through the wall of the body, and
two wings positioned on either side of the blow-hole wherein said wings are:
integrated with the body of the flute,
raised relative to the outer surface of the body,
semi elliptical,
wider than the blow-hole, and
comprised from any of the group of materials consisting essentially of:
bees wax,
plastic,
metal, or
glass; and,
six finger holes positioned along the length of the conical tubiform of the body wherein said finger holes are:
enabled for the production of a full chromatic scale over a range of one and a half octaves,
defined by round cut-outs through the wall of the body, and
configured to be at least partially covered by any of:
finger tips,
tape, or
plug.

2. A method of tuning a tambin comprising the steps of:
obtaining a tambin with:
a body that is configured with
a conical tubiform,
a head defining the widest end,
a foot defining the narrowest end, and
wherein the body is from any of the group of materials consisting essentially of:
wood,
metal,
plastic, or
glass,
a plug for the wider side of the conical tubiform of the body,
a chambered embouchure adjacent to the plug wherein said embouchure is defined by:
a blow-hole rectangular cut-out through the wall of the body, and
two wings positioned on either side of the blow-hole wherein said wings are:
integrated with the body of the flute,
raised relative to the outer surface of the body,
semi elliptical,
wider than the blow-hole, and
comprised from any of the group of materials consisting essentially of:
bees wax,
plastic,
metal, or
glass; and,
six finger holes positioned along the length of the conical tubiform of the body wherein said finger holes are:
enabled for the production of a full chromatic scale over a range of one and a half octaves,
defined by round cut-outs through the wall of the body, and
configured to be partially or completely covered by any of:
finger tips,
tape, or
plug; and,
placing an air-tight plug over one or more of the six finger holes of the tambin.

3. The method of claim 2 wherein the plug is defined by electrical tape.

4. The method of claim 2 wherein the plug is defined by a rubber ribbon with hoops one side, and hooks on the other side, wherein the hooks and loops for locking engagement.

5. The method of claim 2 wherein said tambin is:
twenty-six and six hundred and seventy-five thousandths inches in length;
one inch in diameter at the head; and,
three-quarters of an inch in diameter at its foot.

6. A tambin comprising:
a body that is configured with a conical tubiform;
a plug for the wider side of the conical tubiform of the body;
a chambered embouchure adjacent to the plug; and,
six finger holes positioned along the length of the conical tubiform of the body to enable the production of a full chromatic scale over a range of one and a half octaves.

7. The tambin of claim 6 wherein said body that is configured with:
a head defining the widest end;
a foot defining the narrowest end; and,
wherein the body is from any of the group of materials consisting essentially of either:
wood,
metal,
plastic, or
glass.

8. The tambin of claim 7 wherein said chambered embouchure is defined by:
a blow-hole rectangular cut-out through the wall of the body; and,
two wings: positioned on either side of the blow-hole wherein said wings are:
integrated with the body of the flute,
raised relative to the outer surface of the body,
semi elliptical,
wider than the blow-hole, and
comprised from any of the group of materials consisting essentially of either:
bees wax,
plastic, metal, or
glass.

9. The tambin of claim 8 wherein said six finger holes are:
enabled for the production of a full chromatic scale over a range of one and a half octaves;
defined by round cut-outs through the wall of the body; and,
configured to be partially or completely covered by:
finger tips,
tape, or
plug.

10. The tambin of claim 9 wherein said tambin is:
twenty-six and six hundred and seventy-five thousandths inches in length;
one inch in diameter at the head; and,
three-quarters of an inch in diameter at its foot.

11. The tambin of claim 10 wherein said plug is configured to extend from the head to within the body's tubiform for a distance of one hundred and twenty-five thousandths inches in length.

12. The tambin of claim 11 wherein said blow-hole is three-hundred and seventy-five thousandths of an inch by one half of an inch positioned lengthwise on adjacent to the head of the body one-half of an inch from the edge of the body.

13. The tambin of claim 12 wherein said wings are:
one quarter inch high relative to the outer surface of the body;
six-hundred and twenty-five thousandths of an inch in length; and,
just wider than the blow-hole.

14. The tambin of claim 13 wherein said finger holes are:
five sixteenths of an inch in diameter;
spaced one inch apart; and,
wherein the center of the first hole being positioned two inches from the foot-side edge of the body.

15. The tambin of claim 6 wherein said tambin is:
twenty-five and one hundred and twenty-five thousandths inches in length;
one inch in diameter at the head; and,
three-quarters of an inch in diameter at its foot.

16. The tambin of claim 6 wherein said tambin is:
twenty-seven and eight hundred and seventy-five thousandths inches in length;
one inch in diameter at the head; and,
three-quarters of an inch in diameter at its foot.

17. The tambin of claim 6 wherein said tambin is:
twenty-nine and six hundred and seventy-five thousandths inches in length;
one inch in diameter at the head; and,
three-quarters of an inch in diameter at its foot.

* * * * *